US011225390B2

(12) United States Patent
Monzoni et al.

(10) Patent No.: US 11,225,390 B2
(45) Date of Patent: Jan. 18, 2022

(54) METHOD AND APPARATUS FOR FEEDING AND SPLICING SHEET OF MATERIAL WOUND IN A BOBBIN

(71) Applicant: PHILIP MORRIS PRODUCTS S.A., Neuchatel (CH)

(72) Inventors: Alberto Monzoni, Bologna (IT); Stefano Malossi, Bologna (IT)

(73) Assignee: Philip Morris Products S.A., Neuchatel (CH)

( * ) Notice: Subject to any disclaimer, the term of this patent is extended or adjusted under 35 U.S.C. 154(b) by 156 days.

(21) Appl. No.: 16/613,606

(22) PCT Filed: May 18, 2018

(86) PCT No.: PCT/EP2018/063219
§ 371 (c)(1),
(2) Date: Nov. 14, 2019

(87) PCT Pub. No.: WO2018/211118
PCT Pub. Date: Nov. 22, 2018

(65) Prior Publication Data

US 2020/0198915 A1 Jun. 25, 2020

(30) Foreign Application Priority Data

May 19, 2017 (EP) ..... 17171897

(51) Int. Cl.
*B65H 19/12* (2006.01)
*A24C 5/20* (2006.01)
*A24F 40/70* (2020.01)

(52) U.S. Cl.
CPC ..... *B65H 19/123* (2013.01); *A24C 5/20* (2013.01); *A24F 40/70* (2020.01);
(Continued)

(58) Field of Classification Search
CPC ..... B65H 19/123; B65H 2301/413223; B65H 2301/41745; B65H 2801/81;
(Continued)

(56) References Cited

U.S. PATENT DOCUMENTS 6,397,915 B1 * 6/2002 Amaranti ..... B65H 19/12 156/157
8,381,787 B2 * 2/2013 Elsperger ..... B65H 19/1852 156/502
(Continued)

FOREIGN PATENT DOCUMENTS

DE 94 21 859 12/1996
EP 0 664 268 7/1995
(Continued)

OTHER PUBLICATIONS

PCT Search Report and Written Opinion for PCT/EP2018/063219 dated Jul. 24, 2018 (13 pages).

*Primary Examiner* — William A. Rivera
(74) *Attorney, Agent, or Firm* — Mueting Raasch Group

(57) ABSTRACT

The invention relates to a method for feeding and splicing sheets of material wound in bobbins (20, 21, 22, 23), the method including: providing a rotating wheel (10) having at least a first, a second, a third and a fourth bobbin holder (103, 104, 105, 106) defining a first, a second, a third and a fourth station; unwinding a first sheet of material (201) wound in a first bobbin (20) provided in the first station; detecting the amount of first sheet of material remaining in the first bobbin (20) in the first station; depending on the amount of first sheet of material (201), splicing the first sheet of material (201) unwound from the first bobbin with a second sheet of material (211) unwound from a second bobbin (21) present in the second station; preparing for splicing a third sheet of material in a third bobbin (22) present in the third station including: reading information
(Continued)

about the third bobbin (22) contained in a sticker, label or tag; removing the sticker, label or tag from the third bobbin (22); and rotating the wheel (10) so that the substantially empty first bobbin (20) is moved to the fourth station and the third bobbin is moved to the second station. Further, the invention relates to an apparatus for feeding and splicing materials wound in bobbins (20, 21, 22, 23) for conducting the above method.

15 Claims, 1 Drawing Sheet

(52) U.S. Cl.
CPC ..... *B65H 2301/41745* (2013.01); *B65H 2301/413223* (2013.01); *B65H 2801/81* (2013.01)

(58) Field of Classification Search
CPC ..... B65H 2408/2415; B65H 2557/13; B65H 26/066; B65H 2301/4185; B65H 2402/352; A24C 5/20; A24F 40/70
USPC ..... 242/559, 559.1, 559.2
See application file for complete search history.

(56) References Cited

U.S. PATENT DOCUMENTS

| | | | | |
|---|---|---|---|---|
| 2001/0054642 | A1 | 12/2001 | Landolt | |
| 2002/0130214 | A1* | 9/2002 | Nakamura | B65H 19/126 242/559.2 |
| 2013/0087650 | A1* | 4/2013 | Screaton | B65H 49/34 242/559.2 |
| 2017/0313535 | A1* | 11/2017 | Choplin | B65B 41/16 |
| 2017/0369262 | A1* | 12/2017 | Green | A47K 10/424 |
| 2020/0187552 | A1* | 6/2020 | Monzoni | A24C 5/399 |

FOREIGN PATENT DOCUMENTS

| | | |
|---|---|---|
| JP | S55 84630 | 6/1980 |
| JP | S59 78060 | 5/1984 |
| JP | H08 169599 | 7/1996 |

* cited by examiner

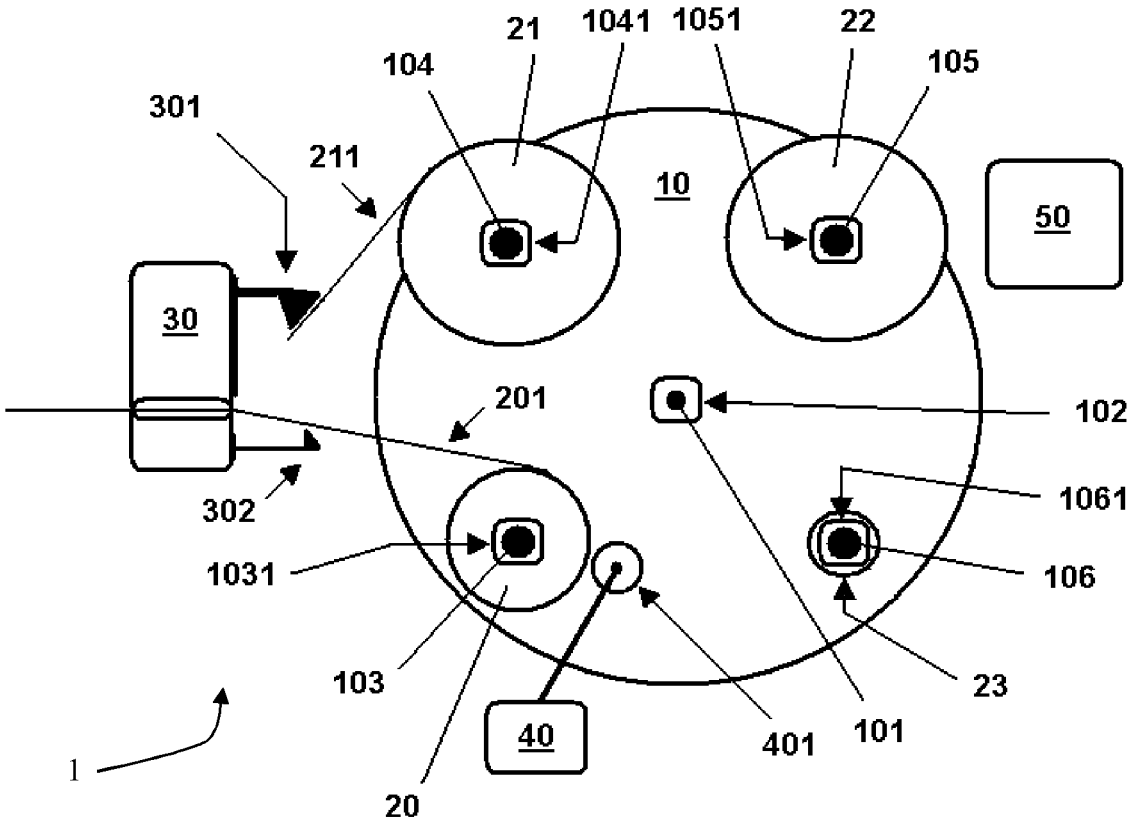
21
1041
1051
22
104
105
301
211
10
50
30
201
102
302
1061
1031
106
103
23
40
401
101
1
20

METHOD AND APPARATUS FOR FEEDING AND SPLICING SHEET OF MATERIAL WOUND IN A BOBBIN

This application is a U.S. National Stage Application of International Application No. PCT/EP2018/063219 filed May 18, 2018, which was published in English on Nov. 22, 2018 as International Publication No. WO 2018/211118 A1. International Application No. PCT/EP2018/063219 claims priority to European Application No. 17171897.6 filed May 19, 2017.

The invention relates to a method and apparatus for feeding and splicing materials in sheet wound in bobbins. In particular, the invention relates to a method and apparatus for feeding and splicing sheet or foil materials wound in bobbins for the manufacturing of aerosol generating articles comprising such sheet or foil material.

In a manufacturing or production process in which a sheet of material is processed which is provided wound in a bobbin, it may be desired to unwind the material from the bobbin at a high speed, so that the material can be processed at an accordingly high speed as well.

However, when the sheet of material is completely consumed and the bobbin is unwound or empty, the manufacturing or production process has to be slowed down or stopped in order to replace the unwound or empty bobbin by a new one.

Furthermore, before continuing the manufacturing or production process, the new bobbin needs to be prepared. This is due to the fact, that usually the sheet of material wound in the bobbin or the whole bobbin including the sheet of material is surrounded by a packaging or is provided with a sticker, label or tag bearing information for example on the material. Consequently, such information has to be read out and checked, and then the sticker, label or tag has to be removed together with the packaging, before the related manufacturing or production process can be continued.

Usually, all or some of these operations have to be conducted manually by an operator. Further, these operations are time-consuming and are subject to defects and faults and have a negative impact on the productivity of the whole manufacturing or production process.

Therefore, an object underlying the invention is to provide a method and an apparatus for feeding and splicing sheet of material wound in bobbins, which allows a higher processing speed of the material in particular when replacing an unwound or empty bobbin by a new one.

According to a first aspect, the invention relates to a method for feeding and splicing a sheet of material wound in bobbins, the method including: providing a rotating wheel having at least a first, a second, a third and a fourth bobbin holder defining a first, a second, a third and a fourth station; unwinding a first sheet of material wound in a first bobbin provided in the first station; detecting the amount of first sheet of material remaining in the first bobbin in the first station; depending on the amount of first sheet of material, splicing the first sheet of material unwound from the first bobbin with a second sheet of material unwound from a second bobbin present in the second station; preparing for splicing a third sheet of material in a third bobbin present in the third station including: reading information about the third bobbin contained in a sticker, label or tag, removing the sticker, label or tag from the third bobbin; and rotating the wheel so that the substantially empty first bobbin is moved to the fourth station and the third bobbin is moved to the second station. According to the invention, it may be possible to keep production at substantially a constant speed, because there is substantially no need to stop or substantially slow down the speed of production during a change from a first bobbin (production bobbin) to a second (new) bobbin. Indeed, it is possible to perform several method steps at the same time. The splicing of the first material unwound from the first bobbin with the second material unwound from the second bobbin when or short before the first bobbin is substantially empty enables to keep a high processing speed of the material and accordingly a high productivity of the overall process. Advantageously, a bobbin is substantially always ready for splicing.

As used herein, the term "sheet" denotes a laminar element having a width and length substantially greater than the thickness thereof. The width of a sheet is preferably greater than about 10 millimeters, more preferably greater than about 20 millimeters or about 30 millimeters. Even more preferably, the width of the sheet is comprised between about 100 millimeters and about 300 millimeters. In a preferred embodiment, the sheet is a sheet of alkaloids containing material, for example homogenized tobacco material. Other plant-based material containing alkaloids can be used as well. Polymeric material sheets are also possible sheets to be deformed into rods.

The most commonly used forms of homogenized tobacco material is reconstituted tobacco sheet and cast leaf. The process to form homogenized tobacco material sheets commonly comprises a step in which tobacco dust and a binder, are mixed to form a slurry. The slurry is then used to create a tobacco web. For example by casting a viscous slurry onto a moving metal belt to produce so called cast leaf. Alternatively, a slurry with low viscosity and high water content can be used to create reconstituted tobacco in a process that resembles paper-making.

The sheet material of tobacco can be referred to as a reconstituted sheet material and formed using particulate tobacco (for example, reconstituted tobacco) or a tobacco particulate blend, a humectant and an aqueous solvent to form the tobacco composition. This tobacco composition is then casted, extruded, rolled or pressed to form a sheet material from the tobacco composition. The sheet of tobacco can be formed utilizing a wet process, where tobacco fines are used to make a paper-like material; or a cast leaf process, where tobacco fines are mixed together with a binder material and cast onto a moving belt to form a sheet.

The sheet of homogenized tobacco material may be rolled in bobbins which are unwound in order to be further processed, to be part for example of an aerosol generating article, that is to be included in the aerosol-forming substrate of the aerosol generating article. A "heat-not-burn" aerosol generating article is a smoking article wherein an aerosol-forming substrate is heated to a relatively low temperature, in order to form an aerosol but prevent combustion of the tobacco material. Further, the tobacco present in the homogenized tobacco sheet is typically the only tobacco, or includes the majority of the tobacco, present in the homogenized tobacco material of such a "heat-not-burn" aerosol generating article. This means that the aerosol composition that is generated by such a "heat-not-burn" aerosol generating article is substantially only based on the homogenized tobacco material.

As used herein, the term "aerosol forming material" denotes a material that is capable of releasing volatile compounds upon heating to generate an aerosol. Tobacco may be classed as an aerosol forming material, particularly a sheet of homogenized tobacco comprising an aerosol former. An aerosol forming substrate may comprise or consist of an aerosol forming material.

The homogenized tobacco sheet generally includes, in addition to the tobacco, a binder and an aerosol-former. This composition leads to a sheet which may be "sticky", that is, it glues to adjacent objects, and at the same time it is rather fragile having a relatively low tensile strength.

The sheet may include a sheet of polymeric material. It may include a sheet of PLA.

Depending on the kind of material, a bobbin (or coil) is to be understood such that it can comprise a carrier, onto which the sheet of material is wound, or the material is wound as such (that means self-supported) into the form of a bobbin or coil. The shape of the bobbin may be any. Preferably, the bobbin have a cylindrical shape.

In the method of the invention, at least three bobbins are present. Usually, the material forming the sheets is the same on all bobbins. However, also bobbins with different kinds of materials can be used.

The method of the invention uses a rotating wheel including four different stations. More stations may be provided as well. Each station may process a different bobbin inserted in a bobbin holder.

Generally, according to the invention, the processing of a bobbin goes through four steps, wherein each step corresponds with one of the four possible stations. Preferably, these stations are cyclically reached by accordingly rotating the wheel on or at which the four bobbin holders are provided. Therefore, a station (which is a given position in space) can be reached by a specific bobbin rotating the wheel: preferably, in case of four different stations, the wheel is rotated by 90° every time a bobbin needs to change station. Different angles may be envisaged as well in case of a number of station different than four.

The first station is preferably a production or unwinding station. The bobbin being positioned at this first station ("first bobbin" or "production bobbin") is unwound, and the unwound material is fed for example to a production machine for the intended further processing of the material. The second station is a waiting and splicing station. The bobbin being positioned at this second station ("second bobbin") is ready to become the first bobbin as soon as it is detected that the current first bobbin is nearly or completely unwound (which means that the first material of or on the first bobbin is nearly or completely consumed). Then, the first material unwound from the first bobbin is spliced with a second material unwound from the second bobbin present in the second station.

The third station is a preparation station at which the bobbin which is positioned at this third station ("third bobbin") is prepared before being moved into the second station by rotating the wheel accordingly. In dependence on the kind of material in which the third sheet wound in the third bobbin, this preparation can be any operation which is necessary or preferred to be conducted before subsequently splicing the material in the second station after the wheel has been rotated.

In this station, information about the third bobbin contained in a sticker, label or tag, are read. Bobbins often contains a stickers, label or tag in which several information are contained. These information are relevant for the rest of the process. In particular, if the wrong information are present, a stop of the process may be commanded. Further, in this station, a removal of the sticker, label or tag from the third bobbin which contained the above mentioned information is performed. The sticker is not necessary any more and its presence may be a hinderance in the further processing step of the method of the invention.

Preferably, the steps are performed in this order, first reading and then removing the sticker, label or tag.

More preferably, the step of removing the sticker is followed by a further step of detaching the end portion of the third bobbin.

By the said rotation of the wheel, the substantially empty first bobbin is moved into the fourth station, the second bobbin is moved into the first station and the third bobbin is moved into the second station.

Preferably, the fourth station is a loading and unloading station, so that at this station, an empty or almost empty bobbin which by the rotation of the wheel came from the first station, can be replaced by a new bobbin. With the next rotation of the wheel, the new bobbin is then moved into the third station.

Further, the term "unwinding" is used throughout the specification to encompass either unwinding in a direction perpendicular to the axis of the bobbin or unwinding in a direction parallel to the axis of the bobbin. The first alternative is usually preferred if the material is a sheet or foil material. If the material has the form of a wire, cable, thread or yarn, both directions can be selected.

With this method, there is no waste of time to process a bobbin before splicing. The sheet of material is ready to be spliced as soon as the used bobbin currently unwound is close to be emptied.

Preferably, the method includes the step of changing the first substantially empty bobbin in the fourth station with a new bobbin. There is no need to block the apparatus to change bobbin. The depleted bobbin is in a station and another bobbin is in a different station and it is unwound.

Preferably, the preparation for splicing a third bobbin may encompass at least one of the following operations: reading further information on the third bobbin; removing a packaging from the third bobbin, checking kind and testing quality of the third material wound in or on the third bobbin; detaching an end portion of the third material from the third bobbin. The preparation for slicing therefore may encompass any operation necessary to be conducted before subsequently splicing the material in the second station after the wheel has been rotated. The selected operation depends on the type of bobbin and on the material. This multitasking approach helps to reduce the production time and minimize human interaction with the machine, improving safety. Information about the third bobbin may be contained not only on the sticker, but also in other part of the third bobbin itself.

Preferably, reading information about the third bobbin contained in the sticker includes emitting an error signal if the information read do not match expected information. The information indicates for example at least one of the kind and quality of the third material and the amount of third material wound in or on the third bobbin. In case the information on the third bobbin or contained in the sticker, label or tag is read during preparation, it is preferred to emit an error signal if the information read do not match the expected information. A quick feedback may be therefore possible.

Preferably, splicing the first sheet of material wound in the first bobbin with the second sheet of material wound in the second bobbin includes: holding an end portion of the second material wound in the second bobbin by suction. The sheet of material wound in bobbins is preferably treated "gently" to avoid breakage of the same. In order to enable a quick and reliable splicing, it is preferred to grasp an end portion of the second material wound in the second bobbin by a grasp mechanism, for example a suction device, which is preferably provided in or at the second station.

Preferably, splicing the materials includes at least one of: welding, hot welding, ultrasonic welding, humidifying and pressing, sticking, adhering, gluing. The kind of splicing is selected according to the kind of material which is used to form the sheet wound in the bobbins. Splicing may be conducted in the form of welding like for example hot welding or ultrasonic welding, or in the form of sticking, adhering or gluing, or by pressing both materials against each other, which preferably have been humidified before.

Preferably, splicing the first sheet of material wound in the first bobbin with the second sheet of material wound in the second bobbin includes cutting the first sheet of material unwound from the first bobbin upstream of the splicing position.

Preferably after splicing, the first sheet of material unwound from the first bobbin is cut upstream of the splicing position and the second bobbin is now unwound and becomes the new production bobbin. Further preferably, during or after splicing, the wheel is rotated in order to move the new production bobbin into the first station, so that the new production bobbin becomes the first bobbin. Most preferably, the second material wound in the second bobbin is unwound already while the wheel is rotating.

If for example, depending on the kind of material, the normal (full) speed with which the material is unwound from the production bobbin is about 300 meter per minute, the speed during splicing could be kept at about 25 meter per minute.

Preferably, the method includes: providing a buffer unit downstream of the rotating wheel; and providing sheets of material stored in the buffer unit downstream of the buffer unit during splicing of the first sheet of material unwound from the first bobbin with the second sheet of material unwound from the second bobbin. In order to further increase this speed, it is preferred to store or buffer the sheet of material unwound from the production bobbin downstream the rotating wheel by means of a buffer unit. By this, the buffered material can be provided downstream of the buffer unit to the further processing especially during the change of a bobbin and in particularly during the splicing operation. This has the advantage that if the change of a bobbin and/or the splicing operation re-quires to slow down or to stop the unwinding of material from the production bobbin, the speed of the material which is fed to the further processing downstream of the buffer unit can be kept (depending on the capacity of the buffer unit) either at the normal (full) speed, or can be kept at least at a higher speed in comparison to the speed with which the material is unwound from the production bobbin during the change of a bobbin or splicing. This has a positive impact on the overall productivity.

Preferably, the method includes unwinding the second sheet of material wound in the second bobbin, while rotating the wheel.

Preferably, at least one of the first, second or third sheet of material includes a polymeric material or a alkaloids containing material. More preferably, the sheet is then used for the production of a component of an aerosol generating article.

According to a second aspect, the invention relates to an apparatus for feeding and splicing materials wound in bobbins, the apparatus including: a rotating wheel having at least a first, a second, a third and a fourth bobbin holder defining a first, a second, a third and a fourth station; an unwinding device adapted to unwind a first sheet of material wound in a first bobbin provided in the first station; a sensor device adapted to detect the amount of first sheet of material remaining in the first bobbin in the first station; a splicer unit adapted to splice the first sheet of material unwound from the first bobbin with a second sheet of material unwound from a second bobbin present in the second station; a preparation unit adapted to prepare for splicing a third bobbin present in the third station, wherein the preparation unit includes: a reading device for reading information about the third bobbin contained in a sticker, label or tag; and a first device for removing the sticker, label or tag from the third bobbin; and an actuator adapted to rotate the wheel when the detected amount of first sheet of material remaining in the first bobbin decreases below a predetermined minimum value, so that the first bobbin is moved to the fourth station and the third bobbin is moved to the second station.

By this, an apparatus is provided which allows to change from a first bobbin (production bobbin) to a second (new) bobbin without stopping the apparatus. By splicing the first sheet of material in the first bobbin with the second sheet of material in the second bobbin when or short before the first bobbin is unwound, a high processing speed of the material and accordingly a high productivity of the apparatus can be realized even during splicing.

Another advantage of this apparatus is, that an empty bobbin can manually be unloaded from the fourth station and a new bobbin can manually be loaded into the fourth station without stopping the apparatus. This further increases the processing speed of the material.

Preferably, the first, second, third and fourth bobbin holders are rotatable around parallel axes.

Preferably, the first, second, third and fourth bobbin holders are equally angularly spaced. In this way, by a rotation of the wheel, all bobbins reaches a different station. In this case the wheel is rotated by each 90° in order to move each bobbin holder from one station to a next station.

Preferably, the actuator which is adapted to rotate the wheel includes a first motor for driving the wheel. Further preferably, the unwinding device includes a second motor for driving each bobbin holder when it is positioned in the first station in order to unwind the first bobbin in the first station. Preferably, such a second motor is positioned stationary in relation to the rotation of the wheel and more preferably positioned below or aside the wheel such that each bobbin holder which is moved into the first station engages with a driving axis of the second motor for rotating the related bobbin holder.

Most preferably, the unwinding device includes a second motor for each bobbin holder, wherein the second motors are positioned on the rotating wheel. In other words, the first to fourth bobbin holder is provided with each an own motor which is preferably mounted on the rotating wheel and activated when it is moved into the first station.

Driving each bobbin holder when it is positioned in the first station is advantageous if the material is unwound in a direction perpendicular to the axis of the bobbin. Alternatively, and in case of unwinding the material parallel to the axis of the bobbin, the material can be drawn off from the related bobbin.

Further preferably, the sensor device adapted to detect the amount of first material remaining in the first bobbin includes a roller rolling on an outside surface of the first bobbin, and a distance sensor or a proximity sensor for sensing the travelling distance of the roller toward a center of the first bobbin holder. By evaluating this distance, the amount of remaining first material can be determined.

The sensor device may include a torque sensor for measuring the torque which has to be generated by the second motor driving the first bobbin holder in the first station for unwinding the first bobbin. Since this torque decreases with decreasing amount of first material in or on the bobbin, the amount of remaining first material in or on the bobbin can be determined by evaluating this torque which the second motor has to generate. The preparation unit adapted to prepare for splicing a third bobbin present in the third station may include at least one of the following devices: a further reading device for reading information on the third; a second device for removing a packaging from the third bobbin; a third device for checking kind and/or testing quality of a third sheet of material wound in or on the third bobbin; and a detaching device for detaching an end portion of the third sheet of material from the third bobbin in order to provide it for splicing.

Preferably, a cutter is provided for cutting the first material unwound from the first bobbin at a position upstream of the splicing position.

A buffer unit downstream of the rotating wheel is preferably provided. Such a buffer unit can comprise for example at least two buffer rollers which can be moved in relation to each other such that they get close to each other and distant from each other. Further, the material is fed for example in U-shape or in the form of one or more meanders around the buffer rollers such that when the buffer rollers are moved closer to each other, an extra length of material is released from the buffer unit and provided downstream the buffer unit.

It is preferred to initiate such a movement of the buffer rollers for releasing an extra length of material during the change of a bobbin and most preferably during splicing the first material unwound from the first bobbin with the second material unwound from the second bobbin. This has the advantage that the speed of the material which is fed to the further processing downstream of the buffer unit can be kept either at the normal (full) speed, or can be kept at least at a higher speed in comparison to the speed with which the material is unwound from the production bobbin during change of a bobbin or splicing.

After a bobbin has been changed and/or the splicing operation has been terminated, the buffer rollers are moved back to their original distance from each other so that the buffer unit receives an extra length of material from the production bobbin.

Such a buffer unit is preferably combined with a fault detection for detecting for example a rupture of the first material during unwinding from the first bobbin. If such a fault or another fault is detected and the apparatus is stopped for removing the fault, the material stored in the buffer unit is delivered for the further processing during the stop of the apparatus.

By this, the delivery of material to the further processing can be kept at a high speed even in case of a fault of the apparatus.

Further advantages of the invention will become apparent from the de-tailed description thereof with no-limiting reference to the appended drawing:

FIG. 1 is a schematic view of an apparatus for feeding and splicing sheet of material wound in a bobbin according to the invention.

In the only FIGURE (FIG. 1), with 1 an apparatus for feeding and splicing sheet of material wound in a bobbin according to the invention is indicated.

The apparatus 1 includes a plate or wheel 10 which is rotatably mounted around a central axis 101. The wheel 10 can be rotated by means of an actuator which comprises a first motor 102 for rotating the wheel in counter-clockwise direction.

The wheel 10 comprises a first bobbin holder 103, a second bobbin holder 104, a third bobbin holder 105 and a fourth bobbin holder 106. Preferably, the bobbin holders are positioned along the circumferential direction of the wheel 10 with equal distances.

Each bobbin holder 103 to 106 is positioned by rotating the wheel 10 in one of a first, a second, a third and a fourth station. In FIG. 1, the first bobbin holder 103 is positioned in the first station, the second bobbin holder 104 is positioned in the second station, the third bobbin holder 105 is positioned in the third station and the fourth bobbin holder 106 is positioned in the fourth station.

Further, the first bobbin holder 103 holds a first bobbin 20, the second bobbin holder 104 holds a second bobbin 21, the third bobbin holder 105 holds a third bobbin 22 and the fourth bobbin holder 106 holds a fourth bobbin 23.

The bobbin holders 103 to 105 are mounted on the wheel 10 such that they are rotatable around an axis perpendicular to the plane of the wheel 10.

Further, four second motors 1031, 1041, 1051, 1061 are positioned on the wheel 10 for driving each one of the four bobbin holders 103 to 105 for unwinding the material on the related first to fourth bobbins 20 to 23. Further, FIG. 1 shows a sensor device 40 which is adapted to detect the amount of first material 201 remaining in the first bobbin 20. More in de-tail, the sensor device 40 preferably includes a roller 401 rolling on an outside surface of the first bobbin 20, and preferably includes a distance sensor or a proximity sensor for sensing the travelling distance of the roller 401 toward a center of the first bobbin holder 103. From this distance, the amount of first material 201 remaining in the first bobbin 20 is determined.

Further, the apparatus according to the invention comprises a splicer unit 30. This splicer unit 30 is positioned stationary in relation to the rotation of the wheel 10 and preferable at the side of the wheel 10 between about the first and the second station. The splicer unit 30 is adapted to splice the first material 201 unwound from the first bobbin 20 with the second material 211 unwound from the second bobbin 21. The kind of splicing is selected according to the kind of material such that both materials 201, 211 can safely be connected with each other.

As schematically indicated in FIG. 1, the splicer unit 30 preferably includes a grasp mechanism 301 for grasping and holding an end portion of the second material 211 of the second bobbin 21. This grasp mechanism 301 can be provided in the form of a suction or vacuum gripper, which is moveable such that the grasped end portion of the second material 211 of the second bobbin 21 is guided to a position within the splicer unit 30 at which it is spliced with the first material 201 of the first bobbin 20. Furthermore, the splicer unit 30 is preferably provided with a cutter 302 for cutting the first material 201 unwound from the first bobbin 20 at a position upstream of the splicing position after the splicing operation has been terminated.

Finally, the apparatus according to the invention comprises a preparation unit 50.

This preparation unit 50 is positioned stationary in relation to the rotation of the wheel 10 and preferable at the side of the wheel 10 in the proximity of the third station. The preparation unit 50 is adapted to prepare for splicing the third bobbin 22 present in the third station. Such a preparation unit 50 can includes at least one of a first device for removing a sticker, label or tag from the third bobbin 22, a reading device for reading information on the third bobbin 22 or contained in the sticker, label or tag, a second device for removing a packaging from the third bobbin 22, a third device for checking kind and/or testing quality of the third material wound in or on the third bobbin 22 and a detaching device for detaching an end portion of the third material from the third bobbin 22 in order to provide it for splicing and/or for being grasped by the grasp mechanism 211.

This apparatus operates as follows:

During unwinding the first material 201 wound in the first bobbin 20 which is positioned in the first station, the sensor device 40 monitors the amount of first material 201 remaining on the first bobbin 20.

When the sensor device 40 detects that the amount of first material 201 remaining in the first bobbin 20 decreases below a predetermined minimum value, the grasp mechanism 301 is activated and grasps an end portion of the second material 211 from the second bobbin 21 present in the second station.

The grasp mechanism 301 guides the end portion to a position within the splicer unit 30 by drawing off a corresponding length of second material 211 from the second bobbin 20, or by driving the second bobbin holder 104 by activating the second motor 1041 for unwinding a corresponding length of second material.

Then this end portion is spliced with the first material 201 of the first bobbin 20 during unwinding the first material 201 from the first bobbin 20.

If depending on the kind of material, the splicing cannot be conducted during unwinding the material 201 from the first bobbin 20 at normal or full speed, the related second motor 1031 driving the first bobbin holder 103 is slowed down or stopped accordingly during the splicing operation. After terminating the splicing operation, the cutter 302 is activated for cutting the first material 201 upstream of the splicing position. By this, the second bobbin 21 is now the production bobbin and is unwound by driving the second bobbin holder 104 by means of the related second motor 1041.

Simultaneously, the first motor 102 is switched on, so that the wheel 10 is rotated by about 90°. When this rotation of the wheel 10 is completed, the second bobbin 21 has reached the first station and the substantially empty first bobbin 20 has reached the fourth station where it can be exchanged by a new bobbin. Further, the third bobbin 22 has reached the second station.

If alternatively as mentioned above, the unwinding device includes only one second motor 1031 which is positioned stationary in relation to the rotation of the wheel 10 for driving each bobbin holder which is positioned in the first station, the second material 211 is to be drawn off from the second bobbin 21 by means of the grasp mechanism 301.

Further, when the wheel 10 is rotated by activating the first motor 102, the engagement between the second motor 1031 and the first bobbin holder 103 is separated, so that the unwinding of the first material 201 from the first bobbin 20 stops.

Before or after activating the first motor 102, the splicing operation is conducted.

The first motor 102 is operated such that as soon as the splicing operation is terminated, or shortly after the splicing operation has been terminated, the second bobbin 21 reaches the first station and the second bobbin holder 104 engages with the second motor 1031 so that now the second bobbin 21 is driven for unwinding and becomes the new first bobbin. Simultaneously, the first motor 102 is switched off and by this the rotation of the wheel 10 is stopped.

Preferably, again the cutter 302 is activated for cutting the first material 201 of the first bobbin 20 after the splicing operation and before the second bobbin 21 is driven for unwinding.

Again, with the termination of the rotation of the wheel 10, the substantially empty first bobbin 20 has reached the fourth station where it can be exchanged by a new bobbin, and the third bobbin 22 has reached the second station.

During unwinding the first bobbin 20 in the first station, the third bobbin 22 being positioned in the third station is prepared for splicing by means of the preparation unit 50.

The preparation unit 50 as mentioned above is provided for conducting at least one of removing a sticker, label or tag from the third bobbin, reading information on the third bobbin or contained in the sticker, label or tag, removing a packaging from the third bobbin, checking kind and testing quality of the third material wound in or on the third bobbin, detaching an end portion of the third material from the third bobbin and any other measure which has to be conducted before splicing.

If the information read do not correspond with the expected information, or if the kind or quality is not as expected, the preparation unit 50 generates a signal indicating to an operator that the third bobbin 22 being present in the third station has to be exchanged. During this preparation and a possible exchange, the unwinding of the current first bobbin does not need to be stopped.

This contributes to the overall processing speed of the materials wound in bobbins.

The invention claimed is:

1. A method for feeding and splicing sheets of alkaloids containing material wound in bobbins, the method including:

providing a rotating wheel having at least a first, a second, a third and a fourth bobbin holder defining a first, a second, a third and a fourth station;

unwinding a first sheet of alkaloids containing material wound in a first bobbin provided in the first station;

detecting the amount of first sheet of alkaloids containing material remaining in the first bobbin in the first station;

depending on the amount of first alkaloids containing sheet of material, splicing the first sheet of material unwound from the first bobbin with a second sheet of alkaloids containing material unwound from a second bobbin present in the second station;

preparing for splicing a third sheet of alkaloids containing material in a third bobbin present in the third station;

rotating the wheel so that the substantially empty first bobbin is moved to the fourth station and the third bobbin is moved to the second station;

wherein the step of preparing for splicing further includes at least one of:

reading additional information on the third bobbin, removing a packaging from the third bobbin, checking kind and testing quality of a third material wound in or on the third bobbin, detaching an end portion of the third material from the third bobbin.

2. The method according to claim 1, including:

changing the first substantially empty bobbin in the fourth station with a new bobbin.

3. Method according to claim 1, wherein splicing the first sheet of alkaloids containing material wound in the first bobbin with the second sheet of alkaloids containing material wound in the second bobbin includes:

holding an end portion of the second material wound in the second bobbin by suction.

4. The method according to claim 1, wherein splicing the materials includes at least one of:

welding, hot welding, ultrasonic welding, humidifying and pressing, sticking, adhering, gluing.

5. The method according to claim 1, wherein splicing the first sheet of alkaloids containing material wound in the first bobbin with the second sheet of alkaloids containing material wound in the second bobbin includes cutting the first sheet of alkaloids containing material unwound from the first bobbin upstream of the splicing position.

6. The method according to claim 1, including:

unwinding the second sheet of alkaloids containing material wound in the second bobbin, while rotating the wheel.

7. The method according to claim 1, wherein the step of preparing for splicing a third sheet of alkaloids containing material in a third bobbin present in the third station includes:

reading information about the third bobbin contained in a sticker, label or tag, removing the sticker, label or tag from the third bobbin.

8. The method according to claim 7, wherein reading information about the third bobbin contained in the sticker, label or tag, includes emitting an error signal if the information read do not match expected information.

9. An apparatus for feeding and splicing sheets of material wound in bobbins, the apparatus including:

a rotating wheel having at least a first, a second, a third and a fourth bobbin holder defining a first, a second, a third and a fourth station;

an unwinding device adapted to unwind a first sheet of material wound in a first bobbin provided in the first station;

a sensor device adapted to detect the amount of first sheet of material remaining in the first bobbin in the first station;

a splicer unit adapted to splice the first sheet of material unwound from the first bobbin with a second sheet of material unwound from a second bobbin present in the second station;

a preparation unit adapted to prepare for splicing a third bobbin present in the third station, wherein the preparation unit includes:

a reading device for reading information about the third bobbin contained in a sticker, label or tag;

a first device for removing the sticker, label or tag from the third bobbin; and an actuator adapted to rotate the wheel when the detected amount of first sheet of material remaining in the first bobbin decreases below a predetermined minimum value, so that the first bobbin is moved to the fourth station and the third bobbin is moved to the second station.

10. The apparatus according to claim 9, wherein the first, second, third and fourth bobbin holders are rotatable around parallel axes.

11. The apparatus according to claim 9, wherein the sensor device includes a roller rolling on an outside surface of the first bobbin, and a distance sensor or a proximity sensor for sensing the travelling distance of the roller toward a center of the first bobbin holder.

12. The apparatus according to claim 9, wherein the preparation unit further includes at least one of:

a further reading device for reading information on the third bobbin;

a second device for removing a packaging from the third bobbin;

a third device for checking kind and/or testing quality of a third material wound in or on the third bobbin; and a detaching device for detaching an end portion of the third material from the third bobbin in order to provide it for splicing.

13. The apparatus according to claim 9, wherein the sensor device includes a torque sensor for measuring a torque which the second motor has to generate for driving the bobbin holder positioned in the first station.

14. A method for feeding and splicing sheets of alkaloids containing material wound in bobbins, the method including:

providing a rotating wheel having at least a first, a second, a third and a fourth bobbin holder defining a first, a second, a third and a fourth station;

unwinding a first sheet of alkaloids containing material wound in a first bobbin provided in the first station;

detecting the amount of first sheet of alkaloids containing material remaining in the first bobbin in the first station;

depending on the amount of first alkaloids containing sheet of material, splicing the first sheet of material unwound from the first bobbin with a second sheet of alkaloids containing material unwound from a second bobbin present in the second station;

preparing for splicing a third sheet of alkaloids containing material in a third bobbin present in the third station;

rotating the wheel so that the substantially empty first bobbin is moved to the fourth station and the third bobbin is moved to the second station wherein the step of preparing for splicing a third sheet of alkaloids containing material is a third bobbin present in the third station includes:

reading information about the third bobbin contained in a sticker, label or tag, removing the sticker, label or tag from the third bobbin.

15. The method according to claim 14, wherein reading information about the third bobbin contained in the sticker, label or tag, includes emitting an error signal if the information read do not match expected information.

* * * * *